US005951420A

United States Patent [19]

Talarico et al.

[11] Patent Number: 5,951,420

[45] Date of Patent: Sep. 14, 1999

[54] SAFETY BALL

[75] Inventors: Mark Talarico; Matthew Arndt; Richard Grapenthin, all of Van Nuys, Calif.

[73] Assignee: Jas. D. Easton, Inc., Van Nuys, Calif.

[21] Appl. No.: 09/072,643

[22] Filed: May 4, 1998

Related U.S. Application Data

[60] Provisional application No. 60/046,056, May 9, 1997.

[51] Int. Cl.[6] ..... A63B 37/06

[52] U.S. Cl. ..... 473/601; 273/DIG. 8

[58] Field of Search ..... 473/600, 601, 473/602, 598, 599, 604, 605; 273/DIG. 8

[56] References Cited

U.S. PATENT DOCUMENTS

| | | | |
|---|---|---|---|
| 3,976,295 | 8/1976 | Heald, Jr. | 473/601 |
| 4,367,873 | 1/1983 | Chang et al. | 473/602 |
| 4,462,589 | 7/1984 | Morgan | 473/598 |
| 4,772,019 | 9/1988 | Morgan | 473/601 |
| 4,840,378 | 6/1989 | Molitor | 473/600 |
| 5,647,590 | 7/1997 | Walker et al. | 473/601 |
| 5,704,858 | 1/1998 | Yang | 473/602 |

*Primary Examiner*—Steven Wong
*Attorney, Agent, or Firm*—Roth & Goldman

[57] ABSTRACT

A durable, composite safety baseball or softball for practice or training purposes having a dual layer core comprised of an inner core of closed cell urethane and an outer core layer of relatively open cell urethane and covered with an outer cover of real or simulated leather which is softer than a conventional game ball and is thus less injurious to players and spectators. The ball is harder than prior practice balls and has payability characteristics substantially the same as conventional game balls when hit, thrown or caught.

19 Claims, 1 Drawing Sheet

SAFETY BALL

CROSS REFERENCE TO RELATED APPLICATIONS, IF ANY

The present application hereby claims the benefit of provisional application Ser. No. 60/046,056 filed May 9, 1997.

BACKGROUND OF THE INVENTION AND PRIOR ART

1. Field of the Invention

The present invention relates to the field of game balls, particularly baseballs and softballs and, more specifically, to balls used for practice or training purposes rather than for play in an actual game.

2. Prior Art

As is well known, baseballs are generally known as "hard balls" for the very reason that they are in fact hard and can seriously injure the ballplayers and others. Even so-called softballs are comparatively hard, at least when they are new and have not been repeatedly hit and softened by contact with a baseball bat or play. Conventional baseballs usually have a cork center, wool yarn winding and a cowhide or horsehide cover sewn thereon.

Practice or training balls are known which are comparatively soft and are considerably less likely to injure a player than are conventional game balls. Typical examples of prior art balls used for practice for training purposes and intended to provide a greater measure of safety to the players and spectators, are shown in U.S. Pat. Nos. 4,462,589 issued Jul. 31, 1984 and 4,772,019 issued Sep. 20, 1988, each relating to a safety ball known by the trademark INCREDI-BALL™, now owned by the assignee of the present application. Although these balls have a coefficient of restitution which approximates that of conventional game balls, they have a different sound and a greater amount of spin when hit and therefore do not perform substantially the same as conventional game balls.

OBJECT OF THE INVENTION

The primary objective of the present invention is to provide an improved ball for practice or training purposes which simulates the characteristics of a conventional ball but which is comparatively less dangerous upon impact with a player.

DESCRIPTION OF THE PREFERRED EMBODIMENT

Figure 1:
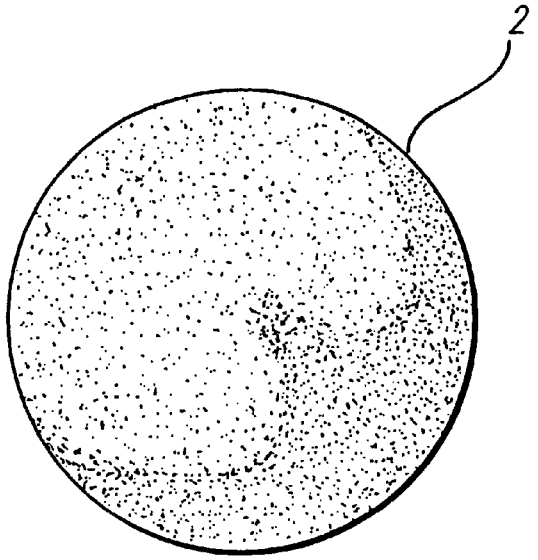
FIG. 1 is a side elevational view, partially broken away, of an inner core portion of a composite safety ball constructed in accordance with the present invention.
Figure 2:
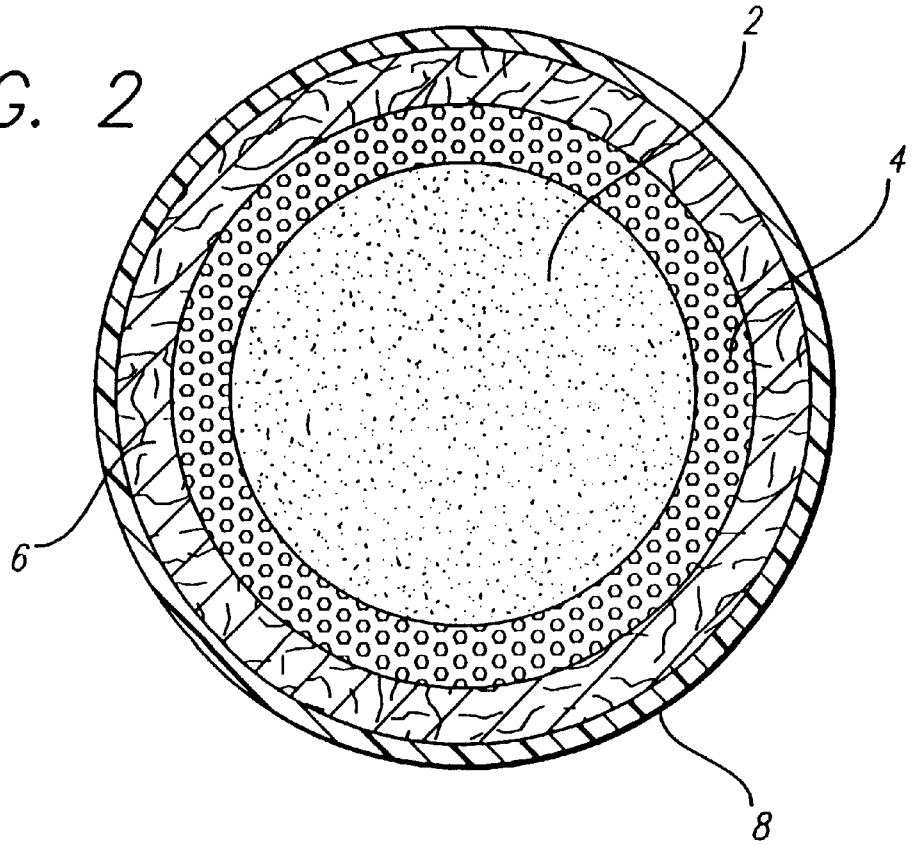
FIG. 2 is a side elevational view corresponding to FIG. 1 and also showing an outer core layer, an optional winding layer and an outer cover added to the inner core of FIG. 1.

Baseballs and softballs of various sizes and weights can be constructed according to the teachings of the invention which is, however, primarily directed to baseballs of 9 inch circumference and to softballs of 11 inch circumference.

The improved safety balls of the present invention are characterized by a multi-layer core including a solid spherical center core 2 made from a closed cell polyurethane material. The term "closed cell" as used herein is a relative term intended to refer to polyurethanes having little or no open cells, whereas the term "open cell" as used herein, is intended to refer to polyurethanes having a significantly larger number of open cells as compared to closed cell polyurethanes. The polyurethane material is derived by mixing (1) polyol involving polyether polyol and preferably a chain extender, silicon surfactant, amine base catalyst and a blowing agent with (2) isocyanate. The resulting mixture is used to form the closed cell spherical center ball core 2 which exhibits a hardness measured by a Shore type A durometer in the range of about 35–40 degrees.

Surrounding the spherical center core 2 is a solid open cell layer 4 of polyurethane material derived by mixing the polyol and isocyanate components (1) and (2) used for the solid spherical center core in different proportions as is known by those skilled in the art to result in an outer layer hardness of 60–65 degrees measured on a Shore Type A durometer.

Suitable chain extenders used in the polyol component of the mixture for the core and surrounding layer include, but are not limited to, ethylene glycol and 1.4 butane diol. Other suitable chain extenders for the polyol component are also well known to those skilled in the art. Also, as will be appreciated by persons skilled in the art, the blowing agent can comprise water or other materials including 141 B.

Suitable materials for the isocyanate component of the mixture include, but are not limited to, toluene diisocyanate and 4.4 diphenymethylene diisocyanate.

Although not presently preferred, optionally, a third layer of the ball may be provided comprising a thin wound layer 6 surrounding the second or outer core layer 4, the wound layer 6 comprising about 2 grams of a polyester thread wound onto the core layer 4 in accordance with standard ball manufacturing techniques. More detailed techniques for construction of balls are disclosed in U.S. Pat. Nos. 4,462,589 and 4,772,019, each relating to balls sold under the INCREDI-BALL™ trademark and owned by the assignee of the present invention, the disclosures of which are specifically incorporated herein by reference.

The outer cover 8 of the ball is finally applied and may constitute a leather or synthetic leather cover of polyvinyl chloride, split leather (a layered cover generally having PVC as the inside layer and a thin layer of inexpensive leather as the outer layer) or cowhide adhered directly to the outer core layer 4 or to the wound layer 6 (if used) by a suitable epoxy.

Baseballs constructed according to the present invention have an outside diameter of about 2.85 inches and a total weight of about 5 oz. When tested to determine the coefficient of restitution and impact force using test methods as disclosed in the materials respectively identified as Annexes A, B, and C to the above mentioned provisional application, incorporated herein by reference, baseballs exhibit a coefficient of restitution of about 0.5 and an impact force of less than about 20 pounds. On the other hand, 11 inch circumference softballs made according to the above teachings have a total weight of about 5.3 oz, and exhibit a coefficient of restitution of about 0.45 and an impact force of about 400 pounds.

Balls constructed as described compare favorably from a safety standpoint with conventional game balls which have significantly higher impact forces and are thus more prone to endanger the players and spectators while accomplishing the intended objective of providing a more risk free practice ball which approximates the playability characteristics of conventional game balls more closely than the prior art practice balls discussed above.

We claim:

1. A reduced impact force game ball for use as a practice or training substitute for a conventional game ball, comprising:

a) a solid spherical center core of closed cell polyurethane material derived by mixing (1) polyol and (2) isocyanate, said center core having a diameter of about 50 mm (1.97"), a weight of from 41 to 45 grams (1.45–1.59 oz.) and a hardness measured by a Shore Type A durometer in the range of about 35–40 degrees;

b) an outer spherical core layer surrounding said center core, said outer core comprising open cell polyurethane material derived by mixing said (1) polyol and said (2) isocyanate, said outer core layer having an outside diameter of about 70 mm (2.75"), a weight of from 73 to 82 grams (2.57–2.89 oz.) and an outer hardness measured by a Shore Type A durometer in the range of about 60–65 degrees; and c) a protective cover surrounding said outer core layer, said ball having an outside circumference of about 9", a total weight of about 142 grams (5 oz.), a coefficient of restitution of about 0.5 and an impact force of less than about 20 pounds.

2. A game ball according to claim 1, wherein said polyol comprises a mixture of polyether polyol, chain extender, silicon surfactant, amine base catalyst and a blowing agent.

3. A game ball according to claim 2, wherein said chain extender is selected from the class consisting of ethylene glycol and 1.4 butane diol.

4. A game ball according to claim 3, wherein said isocyanate is selected from the class consisting of toluene diisocyanate and 4.4 diphenymethelene diisocyanate.

5. A game ball according to claim 4, further comprising a wound thread layer of polyester thread surrounding said outer core layer.

6. A game ball according to claim 4, wherein said blowing agent is water.

7. A game ball according to claim 4, wherein said protective cover is cowhide.

8. A game ball according to claim 4, wherein said protective cover is PVC.

9. A game ball according to claim 4, wherein said protective cover is split leather comprising an outer cowhide layer over an inner layer of PVC.

10. A reduced impact force game ball for use as practice and training substitute for a conventional game ball, comprising:

a) a solid spherical center core of closed cell polyurethane having a diameter of about 50 mm (1.97"), a weight of about 41–45 grams (1.45–1.59 oz.), and a hardness measured according by a shore Type A durometer in the range of about 35–40 degrees;

b) an outer spherical core layer surrounding said center core, said outer core comprising open cell polyurethane material derived by mixing (1) polyol and (2) isocyanate, said outer core layer having an outside diameter of about 86 mm (3.39"), a weight of from 78–82 grams (2.75–2.89 oz.) and an outer hardness measured by a Shore Type A durometer in the range of about 60–65 degrees; and c) a protective cover surrounding said outer core layer, said ball having an outside circumference of about 11", a total weight of about 150 grams (5.3 oz.), a coefficient of restitution of about 0.43 and an impact force of less than about 400 pounds.

11. The game ball of claim 10, wherein said center core is comprised of polyurethane material derived by mixing (1) polyol and (2) isocyanate.

12. A game ball according to claim 11, wherein said polyol comprises a mixture of polyether polyol, chain extender, silicon surfactant, amine base catalyst and a blowing agent.

13. A game ball according to claim 12, wherein said chain extender is selected from the class consisting of ethylene glycol and 1.4 butane diol.

14. A game ball according to claim 13, wherein said isocyanate is selected from the class consisting of toluene diisocyanate and 4.4 diphenymethelene diisocyanate.

15. A game ball according to claim 14, further comprising a wound polyester thread layer surrounding said outer core layer.

16. A game ball according to claim 14, wherein said blowing agent is water.

17. A game ball according to claim 14, wherein said protective cover is cowhide.

18. A game ball according to claim 14, wherein said protective cover is PVC.

19. A game ball according to claim 14, wherein said protective cover is split leather comprising an outer cowhide layer over an inner layer of PVC.

* * * * *